United States Patent [19]

Markowitz

[11] Patent Number: 4,510,836

[45] Date of Patent: Apr. 16, 1985

[54] TOUCH SENSITIVITY IN AN ELECTRONIC MUSICAL INSTRUMENT HAVING NON-POSITIVE ATTACK

[75] Inventor: Jerome Markowitz, Allentown, Pa.

[73] Assignee: Allen Organ Company, Macungie, Pa.

[21] Appl. No.: 557,031

[22] Filed: Dec. 1, 1983

[51] Int. Cl.[3] ..... G10H 1/02; G10H 1/08

[52] U.S. Cl. ..... 84/1.26; 84/1.13; 84/1.22; 84/1.27

[58] Field of Search ..... 84/1.01, 1.03, 1.09–1.13, 84/1.19–1.27, DIG. 7, DIG. 8

[56] References Cited

U.S. PATENT DOCUMENTS

| | | | |
|---|---|---|---|
| 3,507,970 | 4/1970 | Jones | 84/1.01 |
| 3,507,973 | 4/1970 | De Pree | 84/1.24 |
| 3,544,695 | 12/1970 | Dijksterhuis | 84/1.13 |
| 3,570,357 | 3/1971 | Adachi | 84/1.26 |
| 3,571,481 | 3/1971 | Adachi | 84/1.13 |
| 3,582,530 | 6/1971 | Adachi | 84/1.26 |
| 3,626,075 | 12/1971 | Hiyama | 84/1.13 |
| 3,694,561 | 9/1972 | Morez | 84/1.13 |
| 3,715,445 | 2/1973 | Kniepkamp | 84/1.13 |
| 3,784,718 | 1/1974 | Uchiyama | 84/1.13 |
| 3,819,843 | 6/1974 | Okamoto | 84/1.1 |
| 3,943,812 | 3/1976 | Nagai | 84/1.1 |
| 3,971,283 | 7/1976 | Wayne, Jr. | 84/1.26 |
| 4,033,219 | 7/1977 | Deutsch | 84/1.03 |
| 4,079,651 | 3/1978 | Matsui | 84/1.1 |
| 4,099,439 | 7/1978 | Luce | 84/1.26 |
| 4,121,348 | 10/1978 | Niinomi | 84/1.01 |
| 4,195,545 | 4/1980 | Nishimoto | 84/1.26 |
| 4,198,891 | 4/1980 | Weber | 84/1.26 X |
| 4,290,334 | 9/1981 | Kramer | 84/1.26 |
| 4,299,153 | 11/1981 | Hoskinson | 84/1.1 |
| 4,328,731 | 5/1982 | Gotho et al. | 84/1.26 X |
| 4,401,975 | 8/1983 | Ferguson et al. | 84/1.13 X |
| 4,411,185 | 10/1983 | Deutsch | 84/1.27 |
| 4,416,178 | 11/1983 | Ishida | 84/1.19 |

*Primary Examiner*—Stanley J. Witkowski

*Attorney, Agent, or Firm*—Sanford J. Piltch

[57] ABSTRACT

A touch sensitive system for an electronic musical instrument providing a multiple key switch contact system for effecting control over two or more tone generating systems. The first tone generating system operating rapidly in response to the actuation of the key switch to produce a desired voice. The second or subsequent tone generating systems operate sequentially in a delayed manner on the actuation of the key switch effecting a predetermined delay in the production of the desired voice. The audio output of each of the tone generating systems is summed forming a resultant waveform for audio amplification. The key switch actuation, depression and release, causes the tone generating systems to respond immediately to the depression or release of the key switch which effects a change in the envelope characteristics of the resultant waveform.

8 Claims, 3 Drawing Figures

TOUCH SENSITIVITY IN AN ELECTRONIC MUSICAL INSTRUMENT HAVING NON-POSITIVE ATTACK

BACKGROUND OF THE INVENTION

This invention relates to electronic musical instruments which are controlled by a keyboard of the type used in pianos, organs, etc. The invention describes a method for achieving a touch sensitive response to key depressions as heard through the audio system of an electronic musical instrument.

Touch sensitive or touch responsive systems have existed in electronic musical instruments of the analog type for some years. Many such systems comprise a pair of contacts which are actuated by the keys of the keyboard to charge a capacitor. The resulting voltage of the capacitor is directly related to the speed at which a given key is depressed. The resulting voltage, which varies in relation to the speed of the depression of the key, is applied to a gating or similar device creating a periodic waveform for the control of the tone generators of the instrument. Other similar methods have been applied in electronic musical instruments of the digital type. In these instances a varying analog voltage, which may be obtained from an electromagnetic transducer or similar device, is converted into digital information and used to "scale" the amplitude values of the output digital waveform signal. Different arrangements and/or combinations of these systems have also been attempted over the years.

The above methods in either analog or digital tone reproduction systems of the electronic musical instruments in which they were used provided a stepped cyclic reproduction of the sound when heard through a standard audio amplification system. Additionally, digital-type electronic musical instruments are known to have positive attack associated with the keying of the instrument rather than a touch sensitive system for following oo exactly the depression and release of the keys. The positive attack feature requires the completion of the entire attack sequence and may require a certain number of steady state cycles.

It is therefore an object of the present invention to provide complete touch sensitivity to the keys of an electronic musical instrument, whether digital, analog or hybrid, to effect a more realistic response to the play of the instrument. This is accomplished by providing a varying amplitude response related to the speed and time duration at which the keys are played coupled with a non-positive attack function.

Other objects will appear hereinafter.

SUMMARY OF THE INVENTION

The objectives may be achieved by providing a multiple switch contact system for each key of the keyboard or keyboards of the electronic musical instrument. The multiple switch contact system has two or more contacts for effecting control over two or more tone generating systems. The first tone generating system operates relatively rapidly in response to the application of voltage to the first contact by the depression of the key to provide a desired voice. The second tone generating system operates in a delayed manner on the application of a voltage through the second contact as the key is depressed further effecting a predetermined delay in the reproduction of the desired voice which, at the time of such reproduction, causes the amplitude of the summed resulting electrical signals to increase. Additional tone generating systems can be added to the same signal line from the second contact of the key switch incorporating an additional predetermined delay before causing the desired voice to be reproduced and summed as the resulting waveform for audio amplification. Further, a key switch depression and release detector causes the tone generating systems to immediately respond to either a normal or an early release of a depressed key effecting a change in the envelope characteristics from an attack or steady state characteristic to a decay characteristic.

The present invention functions to provide touch sensitivity to the keys of an electronic musical instrument wherein an apparatus comprises a first contact associated with each of the keys so that the first contact, when actuated, causes a predetermined output to occur from a first tone generator. A second contact, also associated with each of the keys, is actuated sequentially after the first contact which causes a predetermined output to sequentially occur from one or more additional tone generators. Each of the sequentially actuated additional tone generators has envelope characteristics associated with the desired voice containing an increasingly greater delay time than any previously actuated tone generator.

To achieve the non-positive attack function, the present invention further comprises a means for the detection of the actuation and release of any key and means for causing the attack and decay transient cycles to occur completely as during normal reproduction of the voice or in a truncated manner as an early release of the depressed key is detected.

BRIEF DESCRIPTION OF THE DRAWINGS

For purposes of illustrating the invention, there are shown in the drawings a form which is presently preferred; it being understood, however, that the invention is not limited to the precise arrangements and instrumentalities shown.

DETAILED DESCRIPTION OF THE INVENTION

The following detailed description is of the best presently contemplated mode of carrying out the present invention. This description is not intended in a limiting sense, but is made solely for the purpose of illustrating the general principles of the invention.

Figure 1:
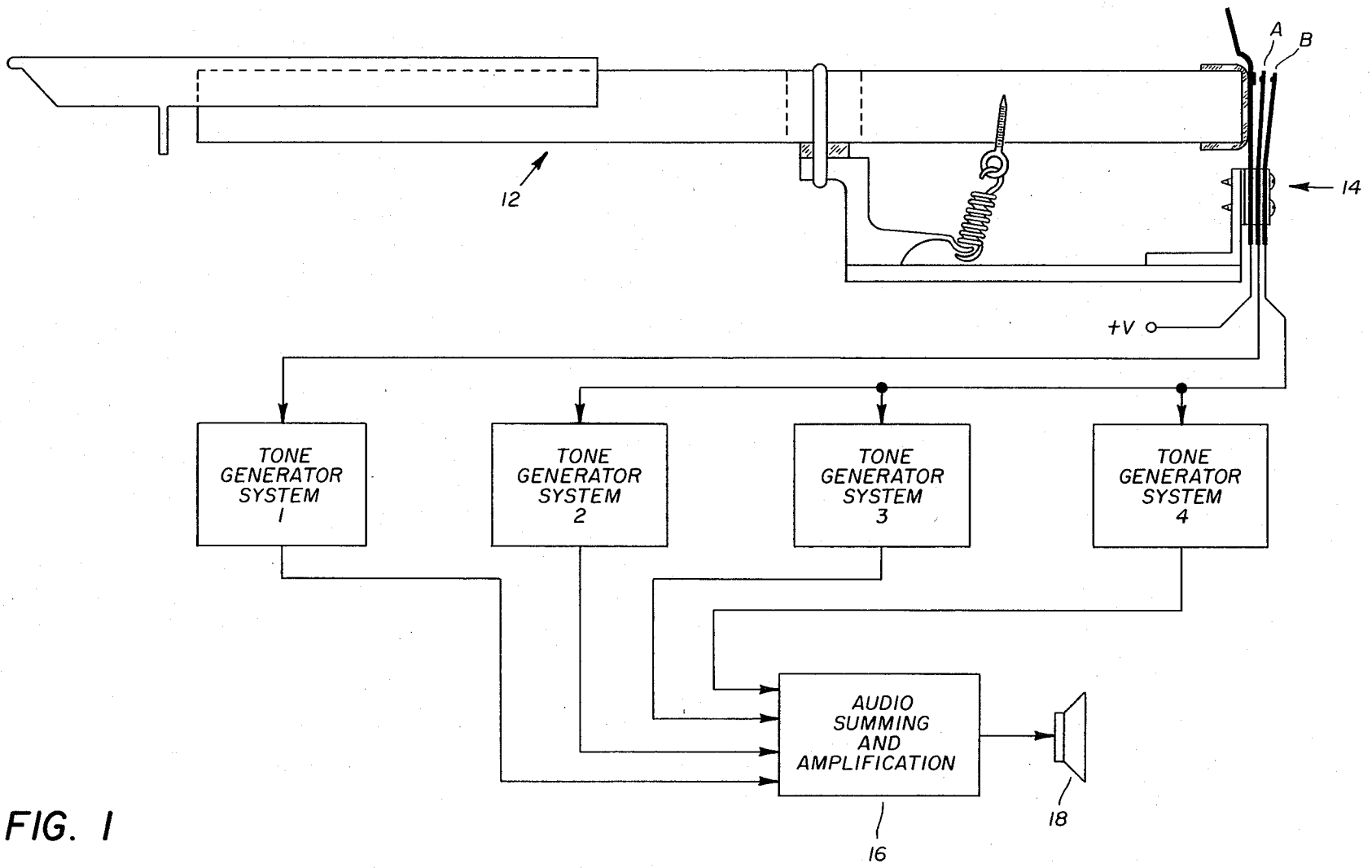
FIG. 1 is a block diagram of an electronic musical instrument embodying an apparatus for providing touch sensitivity to the keys in accordance with the present invention.

Referring now to the drawings in detail, wherein like numerals indicate like elements, there is shown in FIG. 1 a block diagram of an electronic musical instrument embodying the present invention. The electronic musical instrument may be thought of as either an analog or digital type electronic musical instrument. The analog type musical instrument reproduces the desired voice tones through means of discrete filter circuits and the digital type musical instrument reproduces the voice tones through the use of storage devices containing digital representations of the voice wave shape. Both systems use an audio summing and amplification system for converting the electrical signal representative of the voice tone to an audio signal emanating from a speaker system. A third type of electronic musical instrument may be a hybrid of the two borrowing architecture from both of the described systems.

A key 12, of the type commonly used in electronic musical instruments having one or more keyboards, is representative of the entire keyboard or keyboards of such instrument. The representative key 12 consists of the normal elements of a key: a cap, a shaft, a fulcrum pivot, a return spring assembly and a key bed. At the distal end of the key 12 is a key switch 14 having several contracts. In the presently described embodiment one contact of the key switch is connected to a positive voltage, +V. The other two contacts of the key switch 14 are connected to the first tone generator system and additional tone generator systems, respectively.

The contact of key switch 14 closest to the key 12 is connected to a positive voltage +V. The middle contact of key switch 14, contact A, is connected to the tone generator system 1. The remaining contact of key switch 14, contact B, is connected to the additional tone generator systems. This circuit diagram is representative of the actual circuits since the key 12 and key switch 14 are part of a keyboard having multiple keys and key switches which are all connected to the respective tone generator systems. These keys and key switches may be connected either individually or in a multiplexed scheme in accordance with U.S. Pat. No. 3,610,799, assigned to the assignee of the present invention.

The contacts of key switch 14 are arranged so that upon the depression of the key 12 the contact which abuts the distal end of the key is pushed rearward as the key rises in response to the downward pressure on the key cap. As the contact closest to the key is pushed rearward, it contacts the middle contact of key switch 14, contact A, causing the key depression to be sensed by the detection method incorporated within tone generator system 1. As the depression of the key 12 continues and the distal end of the key shaft rises further in response to that depression, the contacts of key switch 14 contact the remaining contact, contact B, causing detection of the key depression in tone generator system 2 and any additional tone generator systems. While it is preferred that the present invention have only two key switch contacts associated with key depression detection, it may be preferred in certain environments to have additional key contacts serving as part of the detection mechanism of the tone generator systems. Thus, due to the mechanical arrangement of the contacts of key switch 14, there is a slight delay between the energization of contact A and energization of contact B.

The tone generator system may be of any design presently used in the field of reproduction of sound in electronic musical instruments. Both the analog and digital types are well known to those skilled in the art and either will suffice for the present invention. Upon the tone generator systems detecting the depression of the key at the time that contact A is energized, the tone generator system initiates the reproduction of the selected voice by beginning the attack portion of the waveform. As the key continues to travel to its maximum displaced position, contact 2 is energized. This will give rise to the beginning of the sound reproduction in the additional tone generator systems, 2, 3, etc., to be described more fully hereinafter. As the key is released, contact B is de-energized first, followed by the de-energization of contact A, causing the selected voice to begin the decay portion of its reproduction stages upon the detection of the release of key. Before describing the relationship of the tone generating systems to each other and to the resulting sound, it is necessary to understand the terms positive and non-positive attack.

A positive attack occurs upon the depression or actuation of a key for causing the reproduction of a selected voice. When positive attack is used, the length of time the key is held depressed is inconsequential since the tone generator system will reproduce the entire attack and a predetermined number of cycles of the waveform before beginning the steady state decay portion of the waveform. Thus, if positive attack is a feature of the tone generator system, once the key is depressed the entire waveform will be reproduced even though the key was released early in the attack portion of the waveform.

A non-positive attack differs from the positive attack in that a detection means senses the release of the key and causes an immediate response to that release. The response in this case being a truncation of either the attack or steady state portions of the waveform and the immediate beginning of the decay portion of the waveform. This occurs regardless of whether the waveform has reached its steady state portion or its maximum amplitude. Thus the non-positive attack feature of the present invention will cause an immediate response to the release of the key which provides a more exact audio response to the playing of that key.

In order to accomplish the non-positive attack feature of the present invention, a means is provided for determining the release of the key in a manner similar to the multiplexed scheme described in U.S. Pat. No. 3,610,799. In that patent a specific tone generating channel is claimed upon the repeated detection of a key depression and a signal is created denoting the attack portion of the waveform. Once claimed the tone generating channel will continue to reproduce the selected voice at the pitch of the depressed key until the predetermined number of steady state cycles are reproduced and the key is released. Upon release of the key, de-energization of the key switch contact, the signal indicative of attack reverses polarity and indicates a decay causing the tone o generating mechanism to begin the decay portion of the waveform. Upon completion of the decay a clear pulse causes the reset of the tone generating mechanism for the receipt of the new key information for reproducing the next selected voice.

One method of reproducing the desired sounds at the appropriate pitch is described in U.S. Pat. No. 3,639,913, assigned to the assignee of the present invention. Thus, in accordance with the teachings of this patent and the above description, the disappearance of the attack signal to the tone generating channel and the occurrence of the key release signal causes a change in the address decoder for the sample point address to the voice memory and the associated envelope generator from an increasing count to a decreasing count. The increasing count would be indicative of an attack or steady state period and the decreasing count would be indicative of a decay period. Thus, in accordance with U.S. Pat. No. 3,639,913, which description is incorporated herein by reference, and the foregoing description, upon depression or actuation of the key the associated tone generator system causes the selected voice to be reproduced and, upon the deactuation or release of the key the associated tone generator system causes the selected voice to immediately go into the decay portion of the waveform and continue reproducing the selected voice until the completion of the decay portion of the waveform.

Figure 2A:
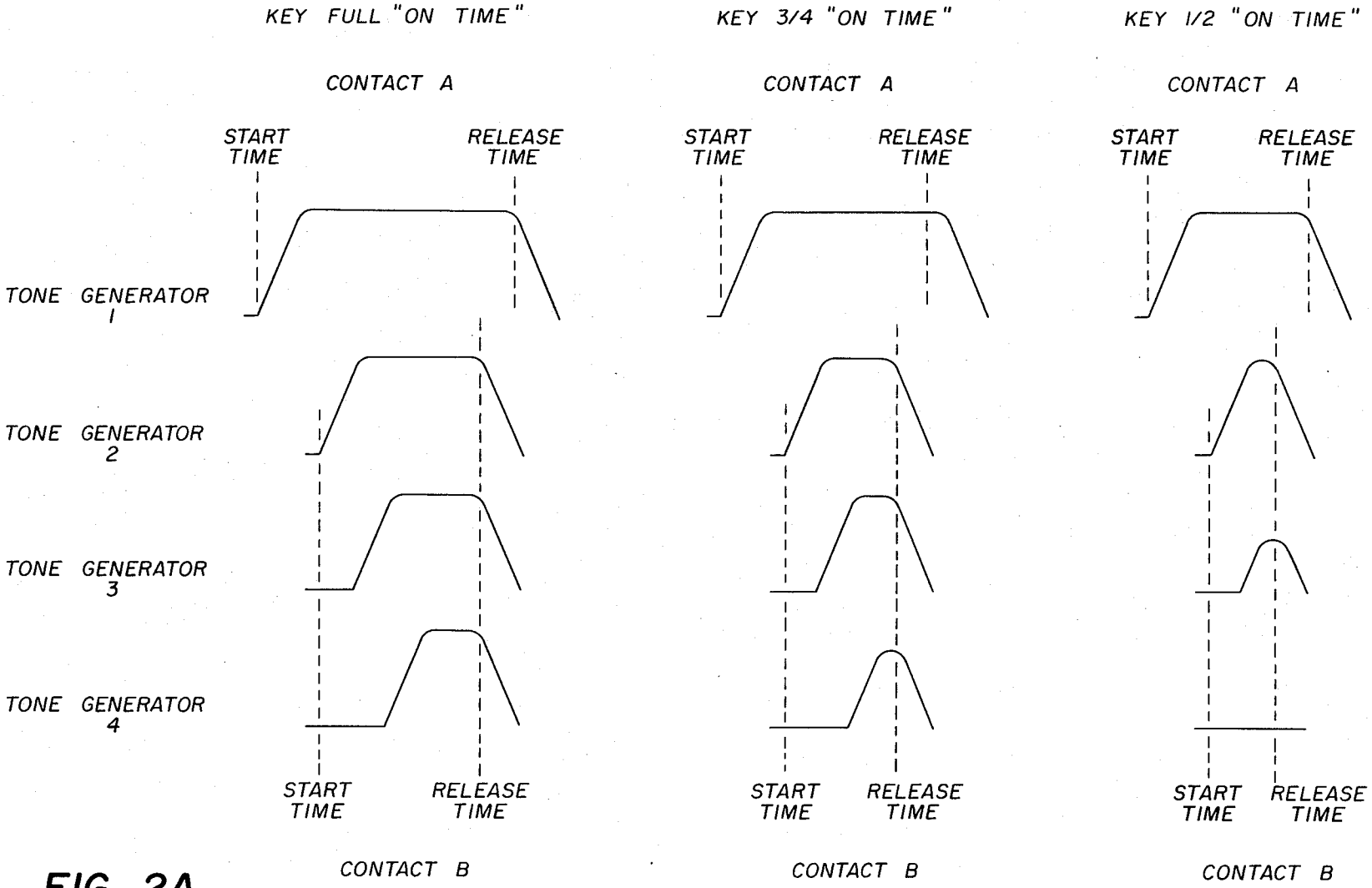
FIG. 2A and 2B are graphical representations of several waveforms representative of the tone generator outputs in response to key depressions of differing lengths of time.
Figure 2B:
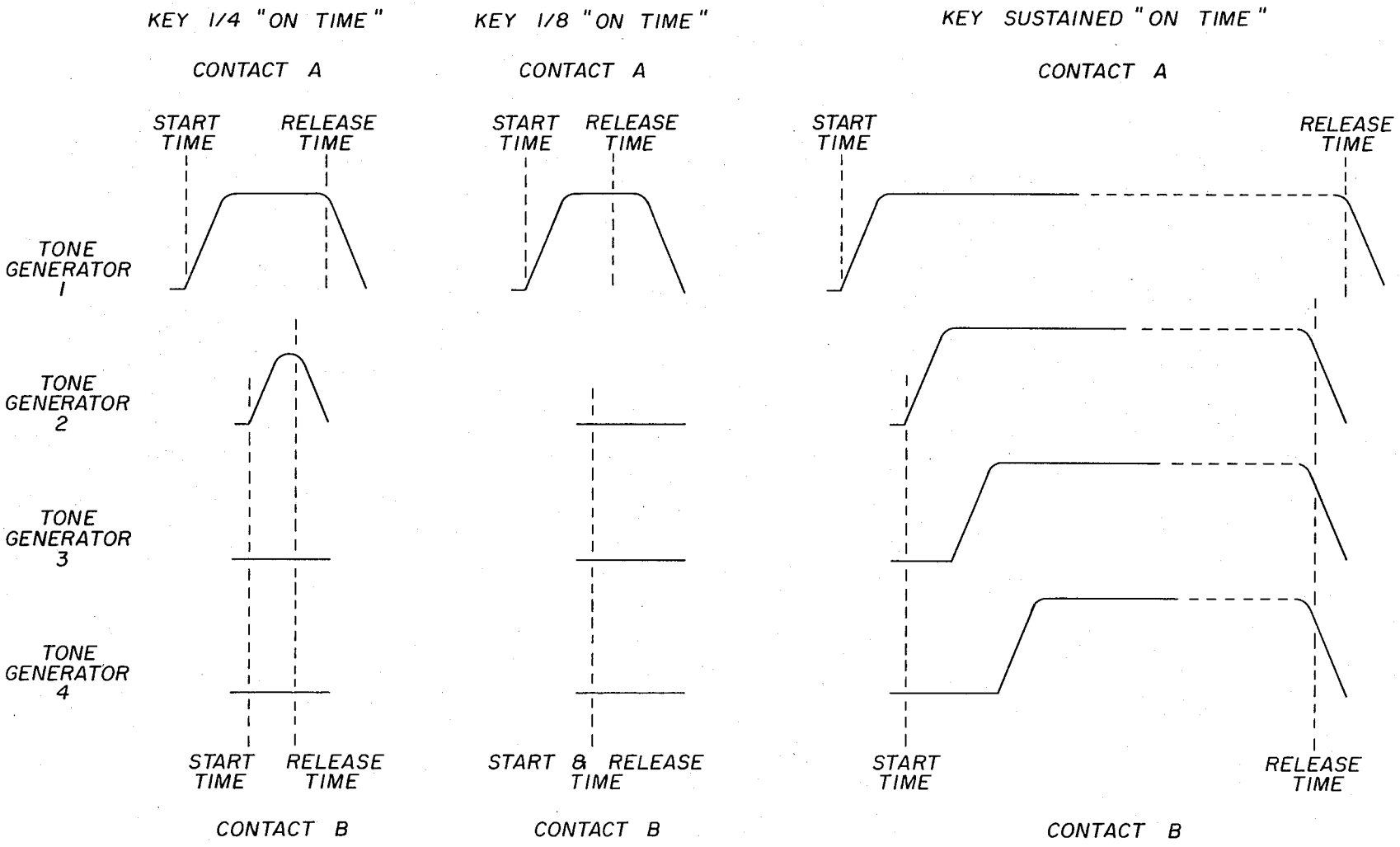

Referring now to FIGS. 2A and 2B, the graphical representations of the waveforms are representative of several varying lengths of time in which the representative key 12 is held depressed. The full 'on time' is representative of the average amount of time in which a key is held depressed during normal play of a musical composition. On detection of key actuation the contact A being energized, tone generator 1 responds by beginning the attack of the selected voice waveform. After the physical delay before contact B is energized, which varies in accordance with the speed with which the key is depressed, tone generator 2 detects the depression of the key and it begins the attack of an associated voice waveform which may be similar or dissimilar to the first voice waveform. The additional tone generators, 3 and 4, detect the energization of contact B at the same moment as tone generator 2 but delay the beginning of the attack of the associated voice waveform a predetermined time so as to cause a greater amplitude (or volume) as the key is held down for a greater amount of time or when the key is being played percussively. It is desired to have a greater volume as the key is played harder and a lesser volume if the key is played for a shorter time.

The delay time of tone generators 3 and 4 may be accomplished through a delay caused by discrete elements or preprogrammed into a read only memory by loading "0" information into the initial locations of the memory. Both methods are well known to those skilled in the art and require no further explanation herein. Upon release of contact B, tone generators 2, 3 and 4 all begin the decay portion of the voice waveform followed after a short physical delay by the release of contact A which causes the voice waveform in tone generator 1 to begin its decay. After the key is released, the tone generators continue to sound their selected voice waveforms until the decay is complete and the audio signal ceases.

The other 'on times' for the keys are proportionately related to the full 'on time' and are to be understood as a faster play of the key. The three-quarter 'on time' does not permit the level of amplitude (or volume) buildup from the resulting outputs of tone generators 3 and 4 as does the full 'on-time.' In the one-half 'on time' tone generator 4 does not cause a sound at all, and tone generator 3 is truncated early on the detection of the release of contact B. The one-quarter 'on time' of the key allows only a truncated voice waveform reproduction from tone generator 2 and no amplitude addition from tone generators 3 or 4. The one-eighth 'on time' allows only tone generator 1 to reproduce the voice waveform with no additions from tone generators 2, 3 or 4 due to contact B being energized only momentarily or not energized at all. The graphical representation of the sustained on time is designed to show an extended full 'on time' where the key is being held depressed for a period of time longer than normal playing. The relationships among the tone generators remain the same even though the key is held depressed for an extended period of time.

Returning to FIG. 1, the output of each of the tone generator systems is an analog signal representative of the desired audio response which is summed and amplified in the audio summing and amplification means 16. It is to be noted that a tone generator system which reproduces sound from a digital memory incorporates a digital to analog converter within that system prior to the exit of the audio signal to the audio summing and amplification means 16. This would not be necessary for an analog or hybrid system which applies a standardized waveform to a discrete filter circuit to achieve the selected voice waveform. The outputs of the discrete filter circuits are analog in nature and can be applied directly to the audio summing amplification means 16. The output of the means 16 is applied to a standard loudspeaker system 18 for conversion of the electrical audio signals to sound waves.

The present invention provides a unique system for causing a specific response to the depression or release of the key as played by the musician. With the non-positive attack function of the present invention the tone generator system responds immediately to the release of the key rather than reproduce the remaining portion of the voice waveform. The delay caused by the physical separation of contacts A and B of key switch 14 and the programmed delay in the sound reproduction means of tone generator systems 2, 3, etc. provide the additional amplitude for the voice waveform when summed with the original audio output of tone generator system 1. This causes a much more sensitive and accurate response to the percussive use of the keys and to the extended or sustained depression of the keys as heard by the listener. Thus the resulting sound caused by the voice waveform reproduction of the tone generating systems causing a varying amplitude response which is directly related to the speed at which the keys are played. This is coupled with the non-positive attack feature which causes the immediate response to the release of any played key. Therefore, the touch sensitivity or touch responsiveness of the keys of an electronic musical instrument, whether digital, analog or hybrid, has been significantly increased to effect a more realistic response to the varied play of such instrument.

The present invention may be embodied in other specific forms without departing from the spirit or essential attributes thereof and, accordingly, reference should be made to the appended claims rather than to the specification as indicating the scope of the invention.

I claim:

1. Apparatus for providing touch sensitivity to the keys of an electronic musical instrument comprising:

a first contact associated with each of the keys, said first contact, when actuated, causing a predetermined tonal output to occur from a first tone generator;

a second contact associated with each of the keys, said second contact, being actuated sequentially after said first contact, causing a predetermined tonal output to sequentially occur from one or more additional tone generators, each of the sequentially actuated additional tone generators having envelope characteristics containing an increasingly greater delay time than any previously actuated tone generator, whereby the actuation of the first and second contacts is directly related to the speed at which the keys are played and results in a varying amplitude and tonal response in accordance with the speed or length of such play.

2. Apparatus in accordance with claim 1 further comprising means for detecting the actuation and release of a key and means for causing the truncation of either the attack transient or the steady state portion of a waveform and causing simultaneously the decay transient to occur immediately upon the detection of the release of the depressed key.

3. Method for providing touch sensitivity to the keys of an electronic musical instrument comprising the steps of:

providing a first contact associated with each of the keys, said first contact, when actuated, causing a predetermined tonal output to occur from a first tone generator:

providing a second contact associated with each of the keys, said second contact, being actuated sequentially after said first contact, causing a predetermined tonal output to sequentially occur from one or more additional tone generators, each of the sequentially actuated additional tone generators having envelope characteristics containing an increasingly greater delay time than any previously actuated tone generator, whereby the actuation of the first and second contacts is directly related to the speed at which the keys are played and results in a varying amplitude and tonal response in accordance with the speed or length of such play.

4. Method in accordance with claim 3 further comprising the steps of: detecting the actuation and release of a key, causing the truncation of either the attack transient or the steady state portion of a waveform and causing simultaneously the decay transient to occur immediately upon the detection of the release of the depressed key.

5. Apparatus for providing touch sensitivity to the keys of an electronic musical instrument comprising a plurality of tone generators for causing a predetermined tonal output upon the actuation of a key, each of said tone generators being operated sequentially by successively causing a delay of the predetermined tonal output from one or more additional tone generators after the first of said tone generators begins to sound, each of the sequentially and successively actuated additional tone generators having envelope characteristics containing an increasingly greater delay time than any previously actuated tone generator resulting in the combined tonal output varying in amplitude and tonal response in accordance with the speed or length of play of the key.

6. Apparatus in accordance with claim 5 further comprising means for detecting the actuation and release of a key and means for causing the truncation of either the attack transient or the steady state portion of a waveform and causing simultaneously the decay transient to occur immediately upon the detection of the release of the depressed key.

7. Method for providing touch sensitivity to the keys of an electronic musical instrument comprising the steps of: providing a plurality of tone generators for causing a poredetermined tonal output upon the actuation of a key, operating each of said tone generators sequentially by successively causing a delay of the predetermined tonal output from one or more additional tone generators after the first of said tone generators begins to sound, each of the sequentially and successively actuated additional tone generators having envelope characteristics containing an increasingly greater delay time than any previously actuated tone generator resulting in the combined tonal output varying in amplitude and tonal response in accordance with the speed or length of play of the key.

8. Method in accordance with claim 7 further comprising the steps of detecting the actuation and release of the key, causing the truncation of either the attack transient or the steady state portion of a waveform and causing simultaneously the decay transient to occur immediately upon the detection of the release of the depressed key.

* * * * *